United States Patent [19]

Karson

[11] 4,224,469

[45] Sep. 23, 1980

[54] STEREO SPEAKER SYSTEM

[76] Inventor: Theodore R. Karson, 3857 N. Oketo Ave., Chicago, Ill. 60634

[21] Appl. No.: 128

[22] Filed: Jan. 2, 1979

[51] Int. Cl.[2] ..... H04R 1/02

[52] U.S. Cl. ..... 179/1 E; 179/1 GA; 181/144; 181/156

[58] Field of Search ..... 179/1 GA, 1 E; 181/144, 181/145, 152, 156, 160, 151

[56] References Cited

U.S. PATENT DOCUMENTS

| | | | |
|---|---|---|---|
| 2,866,514 | 12/1958 | Weathers | 181/151 |
| 3,165,587 | 1/1965 | Alderson | 181/145 |
| 3,712,411 | 1/1973 | Monroe | 181/156 |
| 3,923,123 | 12/1975 | Latimer-Sayer | 181/144 |
| 3,927,261 | 12/1975 | Dahlquist | 181/145 |

FOREIGN PATENT DOCUMENTS

| | | | |
|---|---|---|---|
| 104979 | 9/1938 | Australia | 181/156 |

OTHER PUBLICATIONS

"The Transmission Line Loudspeaker Enclosure," by Bailey, *Wireless World,* May 1972, vol. 78, No. 1439, pp. 215–217.

"The Amazing Maze," by Weems, *Stereo,* Winter 1973, pp. 54–60.

*Primary Examiner*—Douglas W. Olms

*Attorney, Agent, or Firm*—Hill, Van Santen, Steadman, Chiara & Simpson

[57] ABSTRACT

An acoustic speaker system suitable for use with a home stereo system has a bass speaker, a super-tweeter speaker, a tweeter speaker and a midrange speaker. The speakers are disposed in a generally ascending arrangement with the bass speaker occupying the bottom position, the super-tweeter speaker mounted immediately above the bass speaker, the tweeter speaker mounted immediately above the super-tweeter speaker and the midrange speaker mounted above the tweeter speaker. Speakers for left and right channels of a stereo system are disposed in mirror image in two enclosures. The bass speaker is enclosed in a folded trapezoidal transmission line, and the midrange and tweeter speaker are also housed in transmission line enclosures. A second embodiment contains speakers for both channels in one speaker system disposed in mirror arrangement about a diagonal axis, along a flattened S-shaped curve. An adjustable tuning mechanism is provided for fine tuning the bass transmission line enclosure.

6 Claims, 10 Drawing Figures

STEREO SPEAKER SYSTEM

BACKGROUND OF THE INVENTION

1. Field of the Invention

This invention relates to an acoustic speaker system for use with stereo equipment.

2. Description of the Prior Art

Accurate reproduction of recorded music requires a spearker system having a frequency range to beyond the human hearing range, which is about 16 Hz to 30,000 Hz. A single speaker will not faithfully reproduce each frequency in such a large range. A number of speakers reproducing different portions of the human hearing range are commonly employed to provide a speaker system covering the entire range. Cross-over networks are used between frequency ranges, thus placing each transducer in its optimum performance range.

The individual speakers are gnerally arranged with speakers having a particular range spaced adjacent to speakers covering an adjoining frequency range, in particular, the Woofer and mid-range speakers are adjacent each other, which results in the Woofer sucking air out of the mid-range speaker and thereby interfering with accurate reproduction of mid-range frequencies.

Speakers are generally mounted in enclosures to improve the response characteristics thereof. Bass speakers, operating at the lowest frequencies, produce sound waves having the longest wavelengths and require special enclosures for such waves. The higher range speakers, such as the tweeters, require a chamber of smaller dimensions than that of the bass speaker.

The long wavelengths of the bass frequencies require large chambers. The spearker enclosure can be divided with Woofer section and mid-range section separated as is known in the art.

SUMMARY OF THE INVENTION

The present invention comprises a speaker system consisting of a number of speakers such as: a bass speaker, a super-tweeter speaker, a tweeter speaker, and a midrange speaker. For use with home stereo systems, speaker systems for the right and left channels are provided in which the speakers are mirror images about a vertical line of symmetry. The bass speaker is mounted approximately midway between the floor and the top of each speaker enclosure when two speaker enclosures are employed. The midrange speaker, the tweeter speaker, and the super-tweeter speaker are arranged above the bass speaker in a crescent shaped line descending toward the line of symmetry.

All eight speakers for both channels may be housed in one or two enclosures. In the single enclosure configuration, the midrange, tweeter, and super-tweeter speakers of both channels are mounted along a generally flattened S-shaped curve. The centers of the bass speakers lie on a diagonal line which bisects the S-curve.

The giant mass of vibrating air in front of woofer is kept a non-interacting distance from the mid-range speaker by placing the speaker in a location which is off to the side and far enough away from the woofer so individual transducers do not interfere with each other. Such positioning prevents diffraction of sound waves leaving the diaphragm of each transducer because by being near edges of cabinet diffraction is kept to a minimum. When the listener is correctly positioned, such as midway between the enclosures of the dual configuration, the sound waves from each transducer will reach the listener's ears in such a manner as to reproduce the recorded sound accurately with minimal distortion and produce a replica of the original harmonic structure.

A transmission line provides non-resonant bass and properly loads transducer diaphragm with desired air mass drag, and is trapezodial in cross-section and may be fine-tuned by adjusting tuning devices.

The trapezoidal transmission line prevents reentry of rear waves through the transducer diaphragm and absorbs stored or lagging energy which distorts the sound. The bass diaphragms are properly loaded so as to allow frequencies in the range below 20 Hz to be accurately reproduced.

DESCRIPTION OF THE PREFERRED EMBODIMENTS

Figure 1:
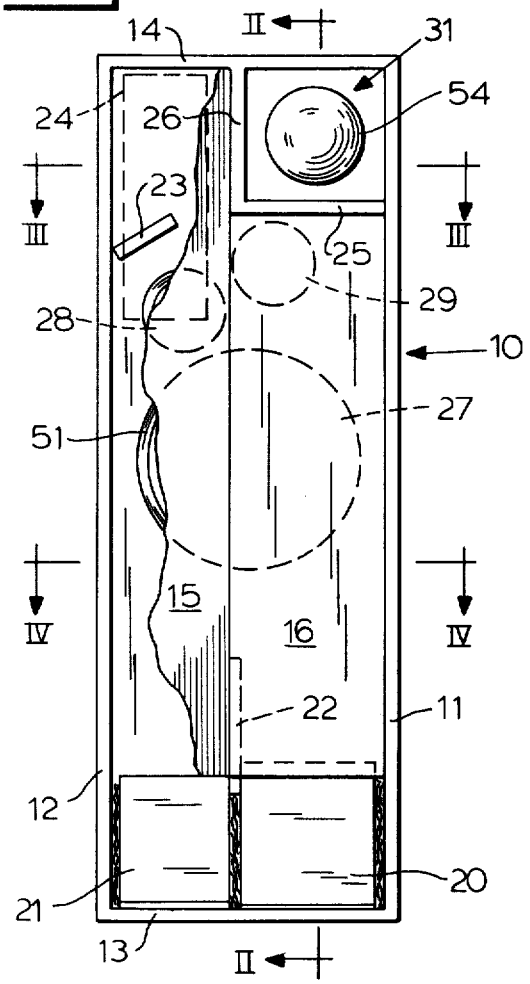
FIG. 1 shown a rear view of a left channel speaker enclosure.
Figure 2:
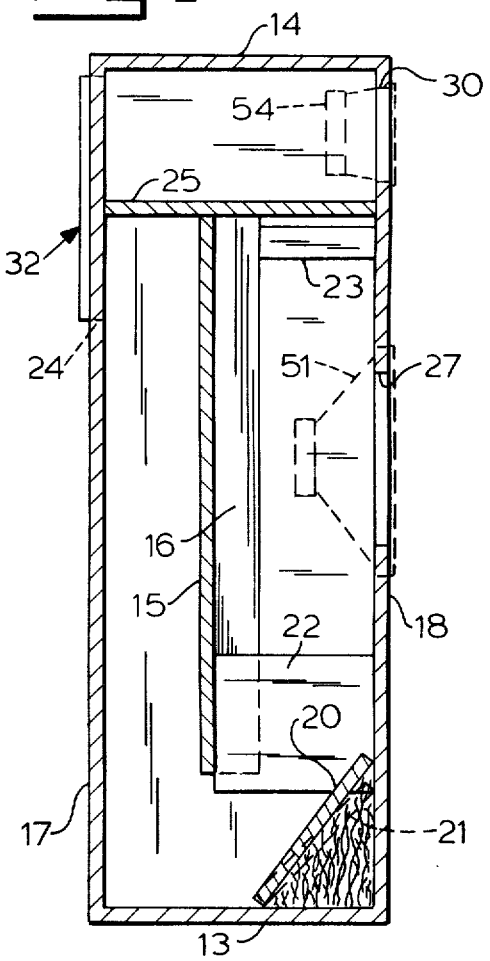
FIG. 2 is a cross-section of the speaker shown in FIG. 1, taken along the line II—II of FIG. 1.
Figure 3:
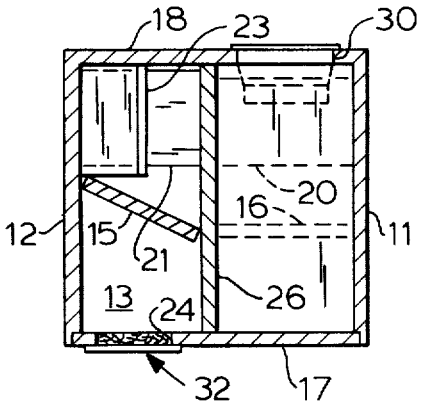
FIG. 3 is a cross-sectional view of the speaker shown in FIG. 1 taken along the line III—III of FIG. 1.
Figure 6:
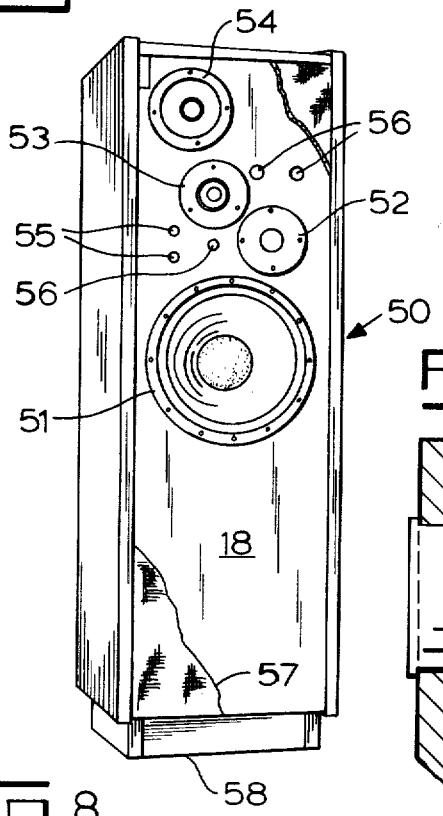
FIG. 6 shows a perspective view of a left channel speaker enclosure system.
Figure 7:
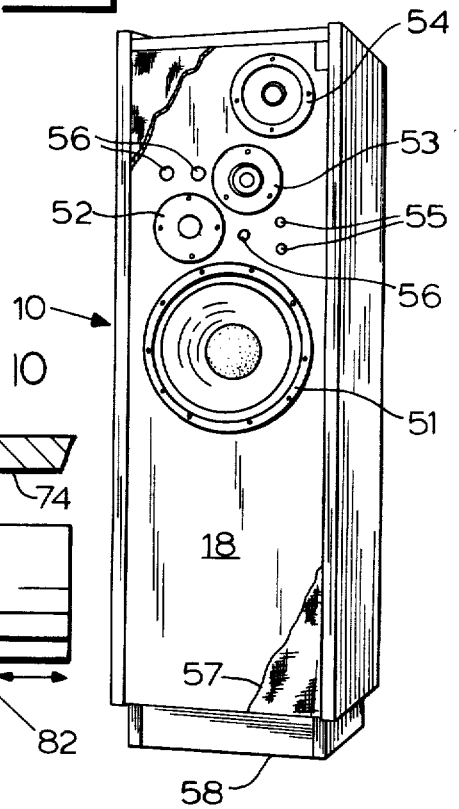
FIG. 7 shows a perspective view of a right channel speaker enclosure system.

A left channel speaker 10 embodying the present invention is shown in FIG. 1. The speaker 10 has an outer enclosure which consists of a bass 13, a top 14, a left side 12, a right side 11, and, as shown in FIG. 2, a back panel 17 and a front panel 18. The front panel 18 has four holes with varying diameters for receiving the four speakers comprising the speaker system. Although only the left channel speaker is shown in FIGS. 1 and 2, it will be understood that the right channel speaker enclosure is a mirror image of the left channel, as shown in perspective views in FIGS. 6 and 7.

The front panel 18 has a hole 27 for receiving a bass speaker 51, a hole 28 for receiving a super-tweeter speaker 52, a hole 29 for receiving a tweeter speaker 53, and a hole 30 for receiving a midrange speaker 34.

All elements comprising the speaker enclosure 10 may be made of a material such as pressed particle board or other suitable wood material.

Figure 4:
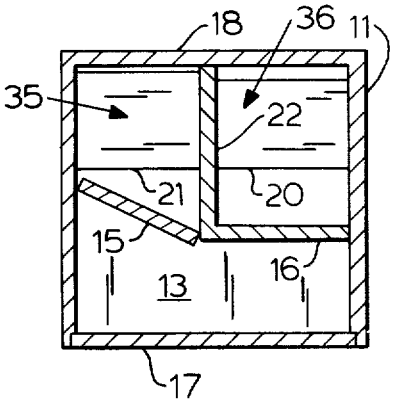
FIG. 4 is a cross-sectional view of the speaker shown in FIG. 1 taken along the line IV—IV of FIG. 1.

A folded transmission line inside the speaker enclosure 10 consists of two portions, 35 and 36. A trapezoidal bass non-resonating cavity 35 is formed by a panel 22 and a panel 15 and portions of the left side 12 and the front panel 18, as shown in FIG. 4. The trapezoidal non-resonating cavity 35 is connected to a cavity 36 formed by panels 22 and 16, and adjacent portions of the right side 11 and the front panel 18. The bass speaker 51 is mounted in the portion of the front panel 18 which forms one side of the cavity 36. A reflecting planar member 20 is mounted at an angle at the bottom of the cavity 36, and is attached at one side of the front panel 18 and at an opposite side to the base 13. A second reflecting planar member 21 is mounted at the bottom of the trapezoidal non-resonating cavity 35 next to the planar member 20. The reflecting planar member 21 is also attached at one side to the front panel 18 and at an opposite side to the base 13, but is mounted at a slightly more acute angle to the base 13 than is the planar member 20. A folded transmission line non-resonating cavity is thus formed by the combination of cavities 35 and 36 which is of sufficient size for the sound components of the bass speaker 51 and proper air mass loading.

A baffle 23 mounted at an upward angle is attached to the side 12 and extends into the non-resonating cavity 35 to capture sound waves reflected off of the top 14 and prevent those reflected waves from interfering with the other waves in the cavity 35. The bass speaker 51 will radiate sound the rear inside enclosure in all directions and maximum absorption is necessary to prevent re-entry of sound through the speaker diaphragm. The slanted planers 20 and 21 and column cavities 35 and 36 are used to divert sound into chambers where the sound is lost and absorbed.

Minimum reflection and maximum absorption occurs when the cavity in which the bass speaker is mounted has a cross-section at least equal to the diameter of the bass speaker 51.

Figure 5:
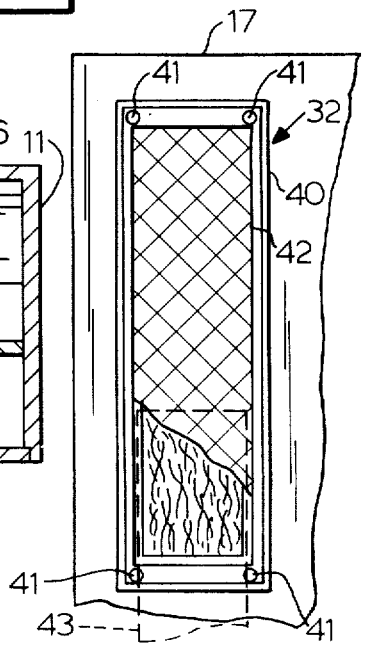
FIG. 5 is a detail view of an adjustable bass tuning slide mechanism.

As shown in detail in FIG. 5, a slide tuning "VAR-I-VENT" TM mechanism 32 may be mounted in a rectangular hole 24 in the upper portion of the back 17 of the speaker enclosure 10. The slide tuning mechanism 32 consists of a frame 40 and a covering 42 which is adjustable to allow proper air flow for the transmission air mass or pressure for the best loading. The frame 40 is attached to the back 17 by a plurality of fastening means 41. A tuner 43 comprised of sound insulating material is slidably engaged in the inner portion of the frame 40, and has dimensions equal to the inner dimensions of the frame 40. The tuner 43 is disposed beneath the covering 42 and can be moved in a vertical direction to selectively open a portion of the hole 24, which allows interaction and coupling of the trapezoidal non-resonating cavity 35 with the air outside of the speaker enclosure 10. The tuning mechanism 32 can be adjusted by means of the tuner 43 to provide the exact amount of atmospheric ineraction which is needed to correct the air pressure at the vent opening produced by the speaker 51. Because there is no usable sound energy at the vent no bass will be cancelled by out-of-phase information.

Figure 10:
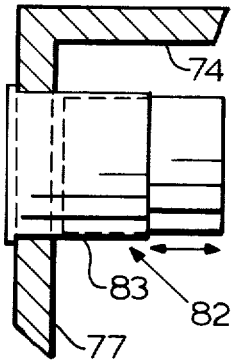
FIG. 10 is a portion of a cross-sectional view taken along the line X—X of FIG. 9.
Figure 9:
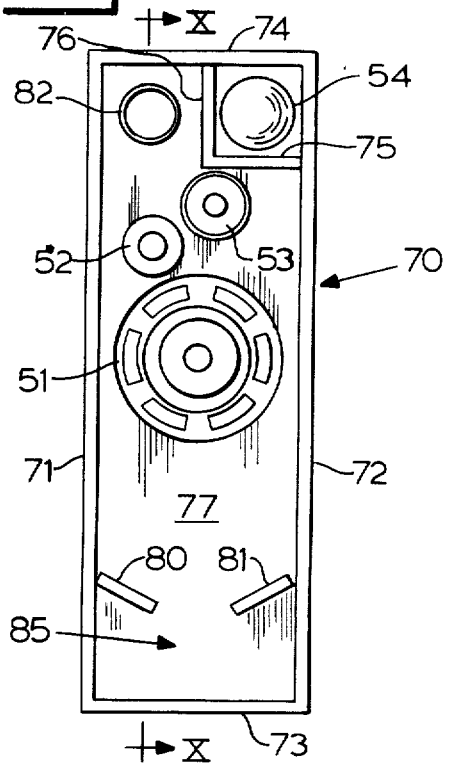
FIG. 9 shows a back view of a left channel speaker enclosure system employing a telescopic adjustably bass tuning mechanism.

A second embodiment of a bass and air mass loading tuning slide mechanism is shown in the speaker enclosure 70 in FIG. 9. The tuner 82, shown in detail in FIG. 10, accomplishes the same result as the slide tuner 32 of FIG. 5. The speaker 70 has a decorative front covering, identical to that shown as 57 in the speakers 10 and 50 of FIGS. 7 and 6 respectively. The decorative front covering 57 is removably carried by means such as velcro strips. Removal of the front covering 70 allows access to the tuning device 82. The tuning device 82. The tuning device 82 consists of a stationary outer portion 83, and a movable inner portion 84, having a diameter slightly smaller than that of the stationary portion 83, and slidably carried inside of the stationary portion 83. The movable portion 84 can be adjusted in a horizontal direction to allow the appropriate amount of atmospheric interaction with the bass non-resonating cavity.

A non-resonating trapezoidal enclosure 31 for the midrange speaker 54 is formed inside the speaker enclosure 10 by panels 25 and 26 and portions of the top 14 and the side 11.

In the embodiment shown in FIG. 9, the bass non-resonating cavity occupies substantially the entire speaker enclosure 70 which comprises a base 73, a top 74 and side walls 71 and 72. The portion of the speaker enclosure 70 which is set off by panels 75 and 76 provides, in conjunction with portions of the top 74 and the side 72, a non-resonating cavity for the midrange speaker 54. A front panel 77 has mounted therein the four speakers comprising the speaker system: a bass speaker 51, a super-tweeter speaker 52, a tweeter speaker 53, and a midrange speaker 54. A pair of baffles 80 and 81 capture reflected waves in a dead space 85 between the baffles and the base 73. The three higher range speakers are arranged in a descending crescent above the bass speaker 51 as in the embodiment of FIG. 1.

As shown in FIGS. 1, 6, 7, and 9, the super-tweeter speaker 52, the tweeter speaker 53, and the midrange speaker 54 form a descending crescent. The super-tweeter speaker 52 is disposed closest to the bass speaker 51. The common arrangement is to have the midrange speaker in closest proximity to the bass speaker, and have speakers of ascending frequency range disposed at increasingly greater distances from the bass speaker. The speaker placement which is the subject of the present invention, however, results in sound reproduction of heightened clarity and more accurate response and natural sound reproduction.

Brilliance controls corresponding to each of the three upper range speakers are mounted in the front panel 18 of each of the speaker enclosures 50 and 10. The controls 56 may be adjusted in accordance with the preference of individual listeners and for even sound output (loudness or volume) of each transducer. Fuse receptacles 55, also mounted in the front panel 18, hold fuses of suitable amperage to prevent speaker blow-out. Each of the speaker enclosures 10 and 50 may rest on a base 58, to insulate the enclosures from interaction with the floor.

Figure 8:
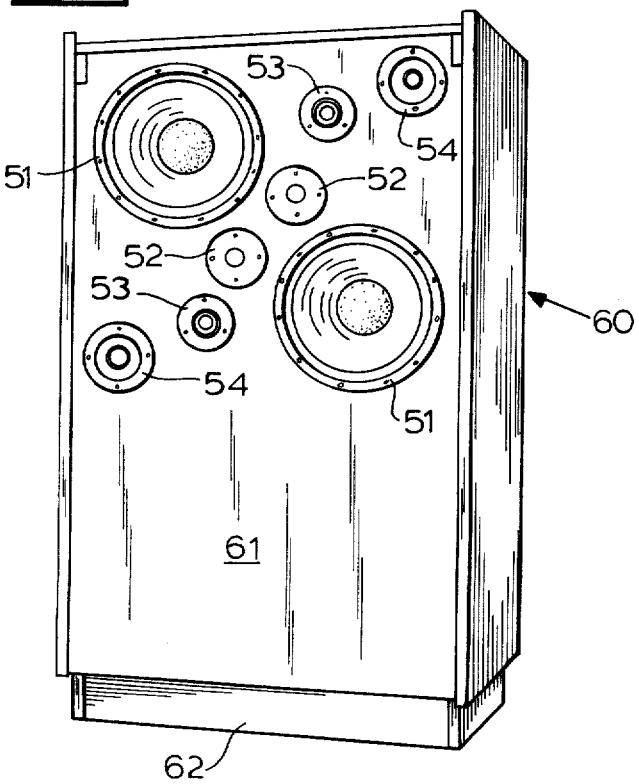
FIG. 8 shows a perspective view of a speaker enclosure system embodying the speakers employed in both channels.

As shown in FIG. 8, applicant's speaker system may be adapted for use in a single enclosure 60. In the single enclosure embodiment of FIG. 8, the speakers are mounted in a flattened S-shaped curve having a midpoint which is bisected by a diagonal on which the center points of the two bass speakers 51 lie. All of the speakers are mounted in a front panel 61, and the speaker enclosure 60 may rest on a base 62. The speakers are still mounted, however, such that the super-tweeter speakers 52 are closest the bass speakers 51, and the midrange speakers 54 are farthest from the bass speakers 51, and the tweeter speakers 53 are mounted between the midrange speakers 54 and the super-tweeter speakers 52 on the flattened S-curve.

Although various minor modifications may be suggested by those versed in the art, it should be understood that applicant wishes to embody within the scope of the patent warranted hereon all such embodiments as reasonably and properly come within the scope of applicant's contribution to the art.

I claim as my invention:

1. A speaker useable in a stereo speaker system, said speaker having an enclosure comprising:

a bottom;

a top;

two vertical sides;

a front panel;

a back panel;

said front panel having a plurality of holes for respectively receiving a bass speaker, a midrange speaker, a tweeter speaker, and a super-tweeter speaker;

said bass speaker generally centrally disposed in said front panel;

said midrange speaker, tweeter speaker and super-tweeter speaker disposed along a line in the shape of a crescent with said midrange speaker disposed at a top of said crescent shaped line nearest said top of said speaker enclosure, and said super-tweeter speaker disposed at a bottom of said crescent shaped line nearest a vertical side and said bass speaker, and said tweeter speaker disposed on said crescent shaped line between said midrange speaker and said super-tweeter speaker;

a non-resonant cavity inside said enclosure having a wall in which said bass speaker is mounted and which is of sufficient length to substantially prevent resonance of audio signals produced by said bass speaker, at least a portion of said non-resonant cavity having a trapezoidal cross-sectional shape in a plane parallel to said bottom; and a tuning means connected to said enclosure for connecting said bass non-resonant cavity with the exterior of said enclosure.

2. The speaker of claim 1 wherein said bass non-resonant cavity consists of two adjacent folded upright portions connected by a horizontal reflecting area, one of said upright portions having the bass speaker mounted therein, said reflecting area having two reflecting planar members each attached at an angle at a first side to said front panel and at a second opposite side to said speaker bottom, said reflecting planar members mounted beneath said upright portions such that sound from said bass speaker travels down a first non-resonant cavity portion, horizontally through said reflecting area, and upward along a second non-resonant cavity portion.

3. The speaker of claim 2 wherein the reflecting planar member beneath the first non-resonant cavity portion makes a greater angle with said speaker bottom than does the reflecting planar member beneath the second non-resonant cavity portion.

4. The speaker of claim 2 wherein a baffle is mounted on one of said vertical sides of said speaker enclosure in the second non-resonant cavity portion, said baffle extending partially into said non-resonant cavity and mounted upwardly at an angle from said vertical side, and at a distance from said top of said speaker equal to approximately ¼ of a total length of said vertical side.

5. The speaker of claim 1 wherein said tuning means comprises:

a frame;

a cover carried immovably inside said frame; and a vertically movable tuner slidably carried inside said frame, said tuner comprised of sound insulating material, such that vertical movement of said tuner selectively varies an operable portion of said cover through which air mass may be transmitted from said bass non-resonant cavity to the exterior of the speaker enclosure.

6. The speaker of claim 1 wherein said tuning means is a tuner, said tuner comprising:

a stationary cylindrical portion immovably mounted in said front panel and extending into the bass non-resonant cavity; and a horizontally movable second cylindrical portion, said second cylindrical portion having an outer diameter slightly smaller than an inner diameter of said stationary portion such that said second portion may be slidably engaged inside said first portion, whereby said second portion may be selectively adjusted to vary the amount of air pressure transmitted from the bass non-resonant cavity to the exterior of the speaker enclosure.

* * * * *